United States Patent [19]

Heiple

[11] Patent Number: 4,848,483

[45] Date of Patent: Jul. 18, 1989

[54] TOOL ATTACHMENT MEANS FOR TRACTORS

[75] Inventor: Ashley Heiple, Alum Bank, Pa.

[73] Assignee: Rockland, Inc., Bedford, Pa.

[21] Appl. No.: 37,723

[22] Filed: Apr. 13, 1987

[51] Int. Cl.[4] ..... E02F 3/76

[52] U.S. Cl. ..... 172/821; 37/117.5

[58] Field of Search ..... 172/821, 820, 822, 823, 172/819; 37/117.5

[56] References Cited

U.S. PATENT DOCUMENTS

| | | | |
|---|---|---|---|
| 3,529,678 | 9/1970 | Teasdale | 172/821 |
| 3,822,751 | 7/1974 | Waterman | 172/821 |
| 3,913,684 | 10/1975 | Casey | 172/821 |
| 4,083,414 | 4/1978 | Yokoyama | 172/821 |
| 4,281,721 | 8/1981 | Beals | 172/821 |
| 4,364,439 | 12/1982 | Asal | 172/821 |
| 4,405,019 | 9/1983 | Frisbee | 172/821 |
| 4,424,871 | 1/1984 | Stickney | 172/821 |
| 4,638,869 | 1/1987 | Murphy | 172/821 |

*Primary Examiner*—Richard J. Johnson

*Attorney, Agent, or Firm*—Lalos & Keegan

[57] ABSTRACT

An attachment for a tractor generally consisting of a main support frame mountable on a tractor, a tool support member mounted on the main support frame for pivotal movement about a first axis, a tool mounted on the tool support member for pivotal movement about a second axis, means operatively interconnecting the main support frame and the tool support member for angularly displacing the tool support member relative to the main support frame about the first axis, and means operatively interconnecting the tool support member and the tool for angularly displacing the tool relative to the tool support member about the second axis.

25 Claims, 3 Drawing Sheets

TOOL ATTACHMENT MEANS FOR TRACTORS

This invention relates to an attachment for tractors and more particularly to an attachment for tractors operable to tilt and angle a working tool at different angles.

In the prior art, there has been developed a type of attachment mountable on tractors which is operable to adjust the attitude of a working tool such as a bulldozer blade. Typically, such attachments are operable to adjust the pitch, tilt and/or angle of the working tool to allow the tractor operator to perform various work functions. Such attachments usually provide some means for universally mounting the working tool on a support frame of the tractor and a set of hydraulic cylinder assemblies for angularly displacing the tool relative to the support frame or tractor.

It has been found, however, that the designs of such attachments in the prior art generally are over-complicated in design, expensive to manufacture, unduly cumbersome to operate and unduly heavy. It further has been found to be desirable to provide such an attachment capable of adjusting the attitude of a working tool mounted on a tractor which is simple in design, easy to operate, effective in performance and easy to service and maintain.

Accordingly, it is the principal object of the present invention to provide a novel attachment for a tractor.

Another object of the present invention is to provide an improved attachment for a tractor for supporting a working tool thereon.

A further object of the present invention is to provide an improved attachment for a tractor having a working tool mounted thereon capable of being adjusted in various attitudes.

A still further object of the present invention is to provide an improved attachment for a tractor for mounting a working tool thereon, capable of adjusting the attitude of the tool by tilting and angling the tool.

Another object of the present invention is to provide an improved attachment for a tractor for supporting a working tool thereon, capable of adjusting the attitude of the tool by adjusting the pitch thereof.

A further object of the present invention is to provide an improved attachment for a tractor for supporting a working tool thereon, capable of tilting and angling the tool which is simple in design, comparatively inexpensive to manufacture, easy to operate, effective in performance and easy to service and maintain.

Other objects and advantages of the present invention will become more apparent to those persons having ordinary skill in the art to which the present invention pertains from the following description taken in conjunction with the accompanying drawings in which.

Figure 1:
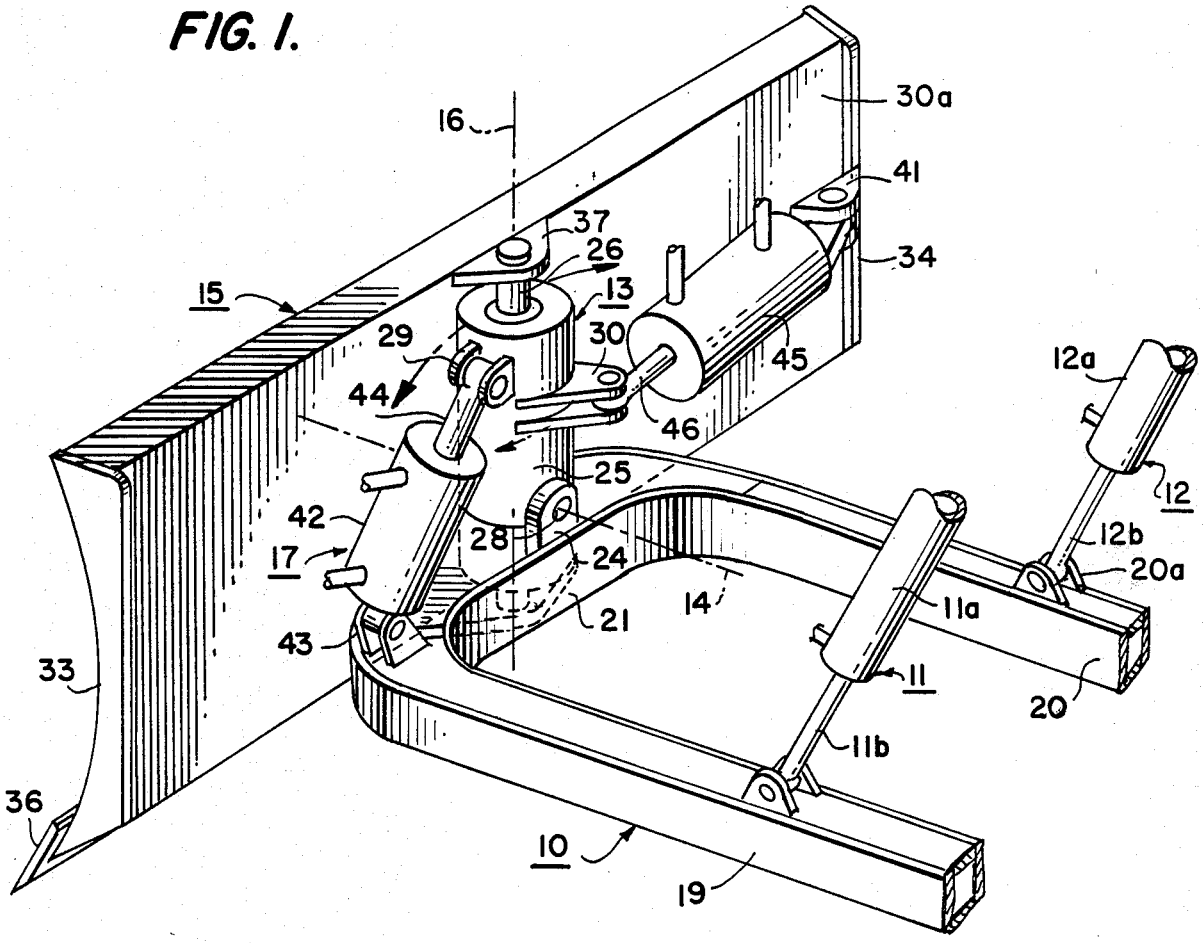
FIG. 1 is a perspective view of an embodiment of the invention.
Figure 2:
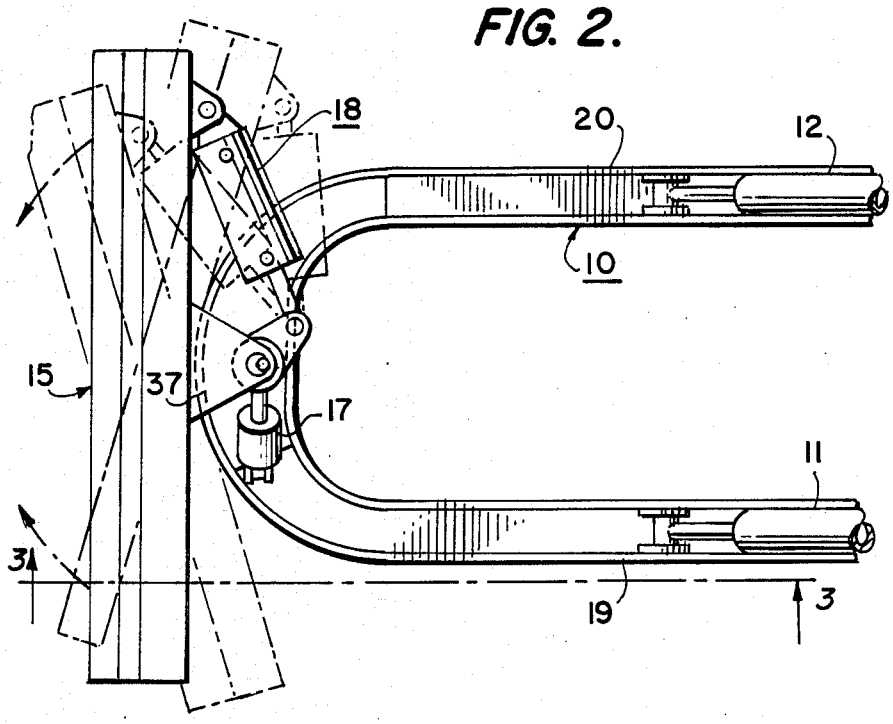
FIG. 2 is a top plan view of the embodiment shown in FIG. 1, illustrating various angular displacements of the working tool thereof in phantom lines.

Referring to FIGS. 1 through 4, there is illustrated an embodiment of the invention generally consisting of a main support frame 10 mountable on a tractor for pivotal movement relative to the tractor about a transverse axis, a pair of lift cylinders 11 and 12, a tool support member 13 mounted on the front end of the main support frame for pivotal movement relative to the main support frame about a longitudinal axis 14 of the main support frame, a working tool 15 mounted on the tool support member for pivotal movement relative to the tool support member about an axis 16 disposed perpendicular axis 14, a hydraulically actuated cylinder assembly 17 operatively interconnecting the main support frame and the tool support member, and a hydraulically actuated cylinder assembly 18 operatively interconnecting the tool support member and the working tool.

Main support frame 10 has a C-shaped configuration including a pair of parallel leg sections 19 and 20 and a forwardly disposed connecting section 21. The rearward portions of leg sections 19 and 20 are provided with means for mounting the rear ends of the main support frame on a tractor for pivotal movement about a transverse axis. Lifting and lowering of the main support frame is provided by hydraulically actuated cylinder assemblies 11 and 12 having cylinder portions **11*a* and 12*a* pivotally connectable to the tractor and rod portions 11*b* and 12*b* pivotally connected to brackets 19*a* and 20*a*** provided on the leg sections of the main support frame.

The main support frame is of a box beam construction and is provided with an opening 22 in section 21 thereof for receiving the lower end of the tool support member therethrough, and a pair of longitudinally aligned mounting brackets 23 and 24.

Figure 3:
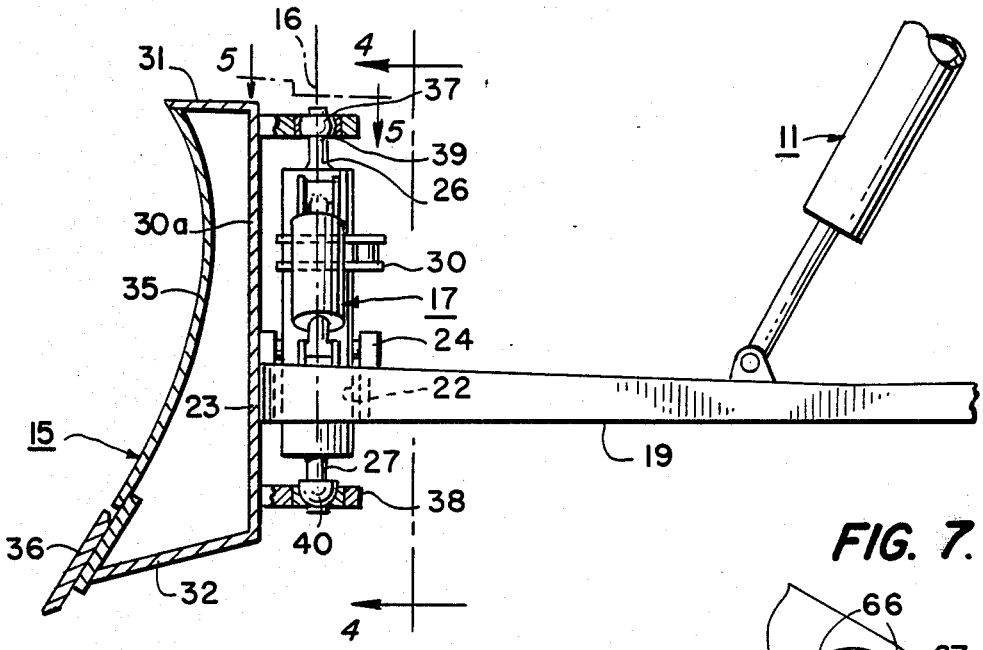
FIG. 3 is a cross-sectional view taken along line 3—3 in FIG. 2.

Tool support member 13 includes a cylindrically shaped main body portion 25 provided with a pair of axially aligned mounting pins 26 and 27 mounted on the upper and lower ends thereof and trunions 28 on a lower side thereof pivotally mounted on brackets 23 and 24 so that the lower end thereof projects through opening 22 in section 21 of the main support frame. As best shown in FIGS. 1 and 3, the axis of trunions 28 coincides with pivot axis 14 and the axis of mounting pins 26 and 27 coincides with pivot axis 16. Main body portion 25 further is provided with a pair of laterally projecting brackets 29 and rearwardly and laterally projecting brackets 30 which are disposed substantially radially relative to pivot axis 16.

Working tool 15, consisting of a bulldozer blade, includes a rear wall member **30*a*, upper and lower wall members 31 and 32, side wall members 33 and 34 and a curved front wall member 35 provided with a cutting edge or scraper blade 36 mounted along the lower end thereof. The rear wall member of blade 15 further is provided with a pair of rearwardly projecting brackets 37 and 38 disposed adjacent to upper and lower wall members 31 and 32, intermediate side walls 33 and 34 of the blade. Such brackets are provided with a set of vertically aligned openings in which there are mounted a set of sealed, self-aligning bearings 39 and 40. Blade 15 is supported on the tool support member by means of mounting pins 26 and 27 being received within and seated on bearings 39 and 40. Rear wall member 30*a* also is provided with a pair of mounting brackets 41** disposed adjacent to side wall member 34 and intermediate upper and lower wall members 31 and 32.

Tilting of blade 15 relative to the main support frame about axis 14 is accomplished by operating cylinder assembly 17 having its cylinder section 42 pivotally connected to a pair of brackets 43 provided on section 21 of the main support frame, and a rod section 44 pivotally connected to mounting brackets 29 of the tool support member. Angling of blade 15 relative to tool support member 13 about axis 16 is accomplished by operating cylinder assembly 18 having a cylinder section 45 pivotally connected to brackets 41 of the blade member and a rod section 46 pivotally connected to mounting brackets 30 of the tool support member. As shown in FIG. 1, the cylinder portions of the hydraulically actuated cylinder assemblies 11, 12, 17 and 18 are provided with fluid supply lines which are connected to a fluid supply system on the tractor provided with suitable controls operated by the tractor operator.

In the operation of the embodiment as described, the height of the blade is first adjusted by operating suitable controls on the tractor to either extend or retract rod portions 11*b* and 12*b* of cylinder assemblies 11 and 12. As soon as the height of the blade has been set, further controls are operated to extend or retract rod portion 44 of cylinder assembly 17 to tilt the blade at the desired angle, and then further controls are operated to extend or retract rod portion 46 of cylinder assembly 18 to set the angle of the blade.

Figure 7:
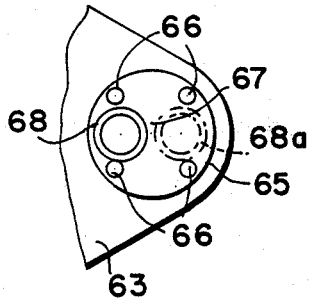
FIG. 7 is an enlarged top view of the means for mounting the working tool to the tool support member of the embodiment shown in FIGS. 6 and 7.
Figure 4:
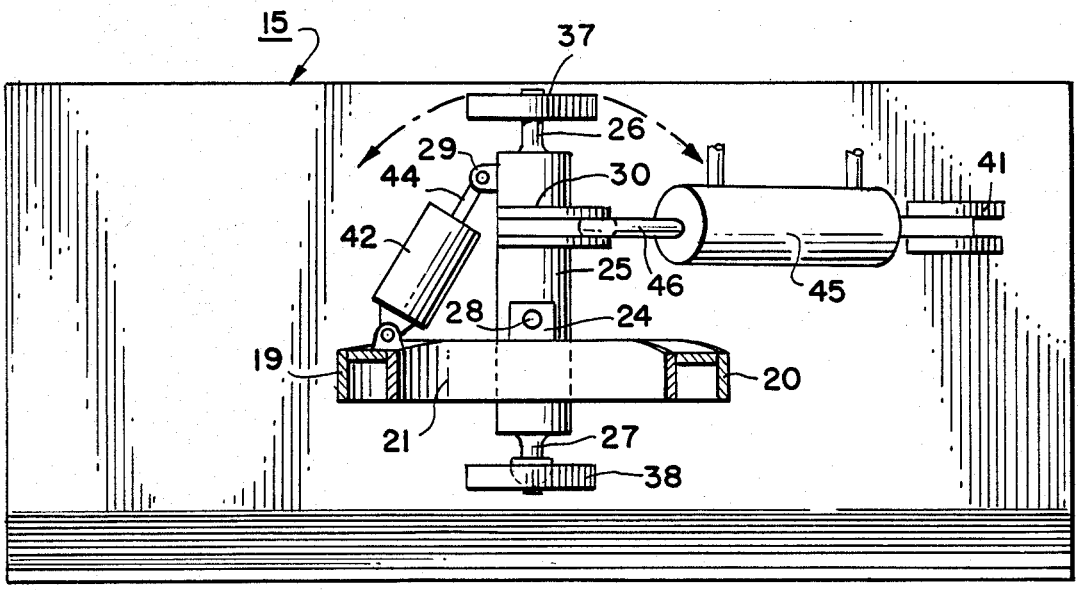
FIG. 4 is a cross-sectional view taken along line 4—4 in FIG. 3.
Figure 5:
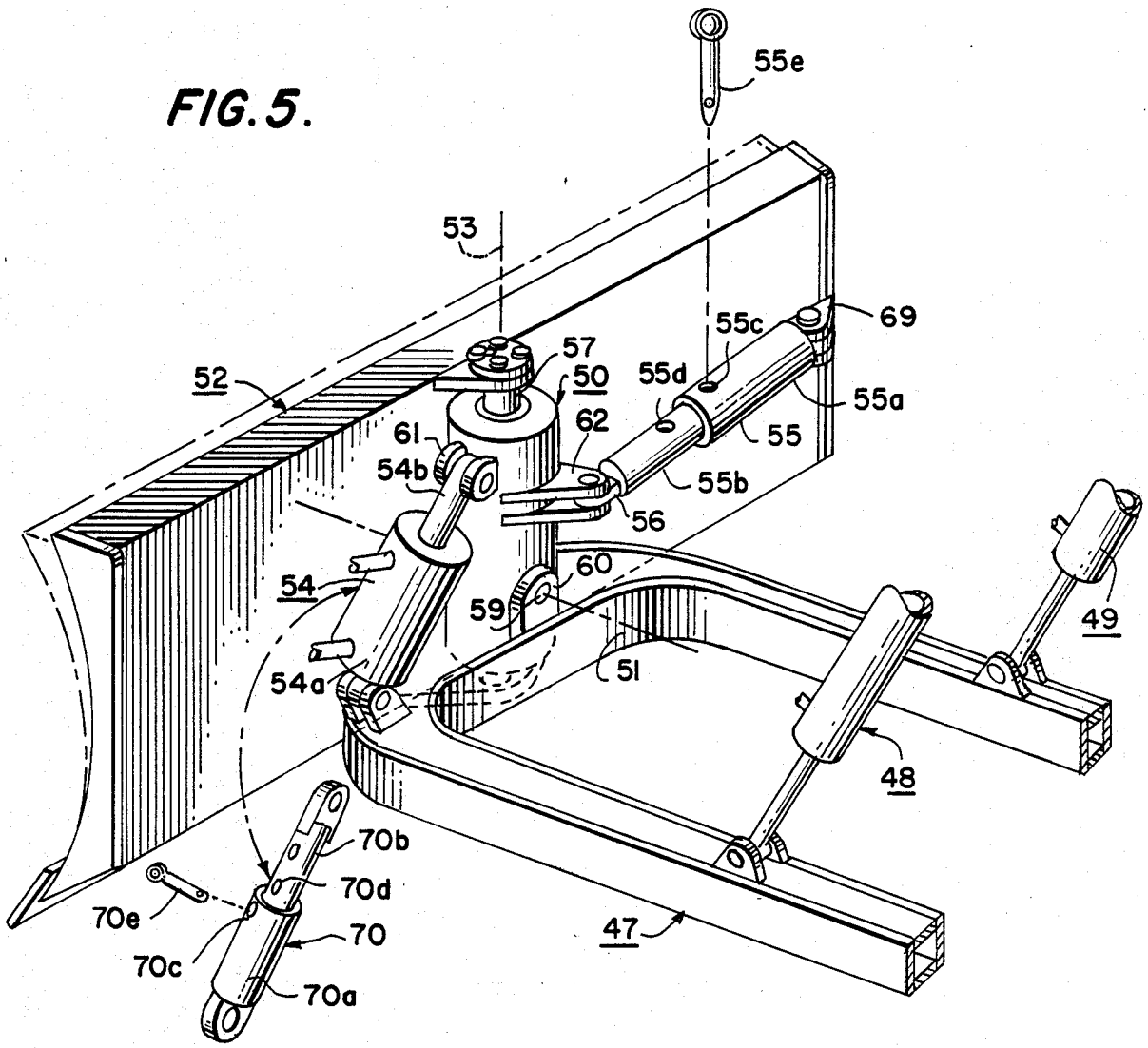
FIG. 5 is a perspective view of another embodiment of the invention.
Figure 6:
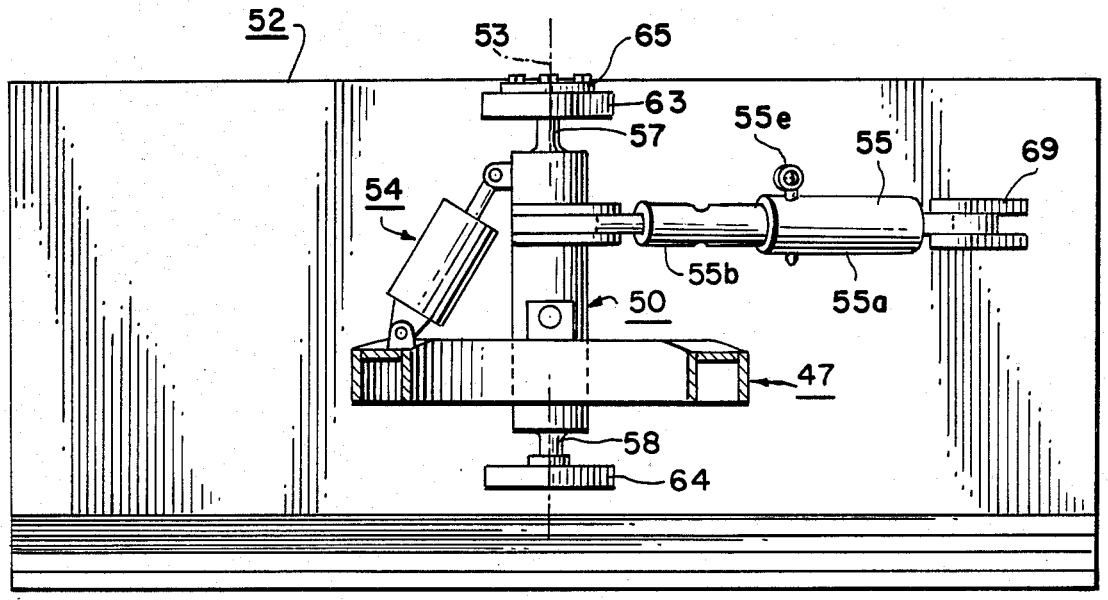
FIG. 6 is a rear elevational view of the embodiment shown in FIG. 5.

Referring to FIGS. 5 through 7, there is illustrated another embodiment of the invention generally consisting of a modification of the embodiment shown in FIGS. 1 through 4. The embodiment includes a main support frame 47 mountable on a tractor for pivotal movement relative to the tractor about a transverse axis, a pair of lift cylinders 48 and 49, a tool supporting member 50 mounted on the front end of the main support frame for pivotal movement relative to the main support frame about a longitudinal axis 51 of the main support frame, a working tool 52 mounted on the tool support member for pivotal movement relative to the tool support member about an axis 53 disposed perpendicular to axis 51, a hydraulically actuated cylinder assembly 54 operatively interconnecting the main support frame and the tool support member, and an extendable link member 55 interconnecting the tool support member and the working tool.

Main support frame 47 and lift cylinders 48 and 49 are comparable in construction and operation to frame 10 and lift cylinders 11 and 12 described in connection with the embodiment shown in FIGS. 1 through 4, respectively. Tool support member 50 includes a main body portion 56 provided with a pair of axially aligned mounting pins 57 and 58 disposed on the upper and lower ends thereof, and trunions 59 disposed on a lower end thereof pivotally mounted on a pair of longitudinally spaced brackets 60 provided on the main support frame so that the lower end thereof projects through an opening in the front end of the main support frame. The axis of trunions 59 coincides with pivot axis 51 and the axis of mounting pins 57 and 58 coincides with pivot axis 52. Main body portion 56 further is provided with a pair of laterally projecting brackets 61, and a set of rearwardly and laterally projecting brackets 62 which are disposed substantially radially relative to pivot axis 53.

Working tool 52, consisting of a bulldozer blade is comparable to working tool 15 described in connection with the embodiment shown in FIGS. 1 through 4. The rear wall member of blade 52 is provided with a pair of rearwardly projecting brackets 63 and 64 disposed adjacent to upper and lower wall members thereof, and intermediate the side walls of the blade. Lower bracket 64 is provided with a self-aligning bearing in which lower mounting pin 58 is seated for partially supporting the blade member. FIG. 7, upper mounting bracket 63 is provided with a cap member 65 detachably mounted on the upper side thereof by means of four bolts 66. The bolts are radially spaced equally from a vertical axis 67 and are equally spaced circumferentially relative to each other. Eccentrically disposed relative to axis 67 is a self-adjusting bearing 68 which receives the upper end of mounting pin 57 through an opening provided in bracket 63.

Tilting of blade 52 relative to the main support frame about axis 51 is accomplished by operating cylinder assembly 54 having its cylinder section 54*a* pivotally connected to a pair of brackets provided on the main support frame, and a rod section 54*b* connected to mounting brackets 61 on the tool support member. Angling of blade 52 relative to tool support member 50 about axis 53 is accomplished by setting the length of extendable link 55. The link includes a cylindrical section 55*a* and a rod section 55*b*. Cylindrical section 55*a* is pivotally connected to a set of mounting brackets 69 mounted on the rear wall of the blade adjacent to a side wall thereof. Rod section 55*b* is slideably received at one end thereof within the open end of cylinder section 55*a* and is pivotally connected at the free end thereof to mounting brackets 62. Cylindrical section 55*a* is provided with a pair of vertically aligned pin receiving openings 55*c* which are adapted to register selectively with a set of longitudinally spaced pin receiving openings 55*d* provided in rod section 55*b*. A locking pin 55*e* is provided for insertion into openings 55*c* registered with selected holes 55*d* to fix the length of link 55.

In the operation of the embodiment shown in FIGS. 5 through 7, the height of the blade is first adjusted by operating suitable controls on the tractor to either extend or retract cylinder assemblies 48 and 49. As soon as the height of the blade has been set, the angle of the blade may be set by removing locking pin 55*e* pivoting the blade about axis 53 to the desired angle so that pin receiving holes 57*c* register with a selected hole of holes 55*d* and reinserting locking pin 55*e* in the registered holes. Further controls are then operated to extend or retract cylinder assembly 54 to tilt the blade at the desired angle.

If it further is desired to adjust the pitch of the blade, prior to adjusting the height, angle and tilt of the blade, cap bolts 66 may be removed and the cap plate may be pivoted 90° or 180° relative to axis 67 and the cap bolts may be replaced. Such rotational adjustment of the cap member to a position as designated by phantom lines 68*a* will have the effect of pitching the blade rearwardly. Although the cap member shown in FIG. 7 is provided with only four bolts, it is to be understood that a greater number of such bolts may be used to provide a greater number of increments of displacement of blade pitch. Furthermore, the radial displacement of the bolts relative to centerline 67 also would have the effect of varying the amount of displacement of blade pitch.

In a further modification of the embodiment as shown in FIGS. 5 through 7, an extendable link 70 may be substituted for cylinder assembly 54 to provide for tilting the blade. As best illustrated in FIG. 5, extendable link 70 includes a cylindrical section 70*a* having an end portion pivotally connectable to the set of mounting brackets on the main support frame, and a rod section 70*b* having a free end portion pivotally connectable to mounting brackets 61 on the tool support member. Cylinder section 70*a* also is provided with a pair of aligned pin receiving openings 70*c* which are adapted to register with a set of longitudinally spaced openings 70*d* in rod section 70*b* for receiving a locking pin 70*e* therein.

Although the embodiments as described utilize a tool consisting of a bulldozer blade, it is to be understood that other forms of tools may be utilized within the scope of the invention. It further is contemplated, that in lieu of a bulldozer blade as described, a rake, shearing blade, stump splitter, grapple, bucket and the like may be used. The only requirement of such other tools is that they be provided with a pair of suitable brackets for mounting the tool on the tool support member, and a set of brackets for connecting the rod portion section of cylindrical assembly with an extendable link.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An attachment for a tractor comprising a main support frame mountable on said tractor, tool support means mounted on said main support frame for pivotal movement about a first axis disposed along a longitudinal centerline of said main support frame, a tool mounted on said tool support means for a pivotal movement about a second axis, means operatively interconnecting said main support frame and said tool support means for angularly displacing said tool support means relative to said main support frame about said first axis, and means operatively interconnecting said tool support means and said tool for angularly displacing said tool relative to said tool support means about said second axis.

2. An attachment according to claim 1 wherein each connection of said tool to said tool support means includes a self-aligning bearing.

3. An attachment according to claim 1 wherein said second axis is disposed perpendicular to said first axis.

4. An attachment according to claim 1 wherein said main support frame includes means for mounting said main support frame on said tractor for angular displacement of said support frame relative to said tractor about a third axis.

5. An attachment according to claim 4 including means mounted on said main support frame and operatively connectable to said tractor for angularly displacing said main support frame relative to said tractor about said third axis.

6. An attachment according to claim 5 wherein said means for angularly displacing said main support frame relative to said tractor comprises at least one hydraulically actuated cylinder assembly.

7. An attachment according to claim 1 wherein said tool comprises a bulldozer blade.

8. An attachment according to claim 1 wherein said tool comprises a rake.

9. An attachment according to claim 1 wherein said tool comprises a shear blade.

10. An attachment according to claim 1 wherein said tool comprises a bucket.

11. An attachment according to claim 1 wherein said main support frame has a C-shaped configuration.

12. An attachment according to claim 1 wherein said tool support means is a trunion mounted on said support frame.

13. An attachment according to claim 12 wherein said tool support means includes a portion projecting through an opening in said main support frame.

14. An attachment according to claim 13 wherein said tool includes a pair of brackets each pivotally mounted on an end portion of said tool support means.

15. An attachment according to claim 1 wherein said means for angularly displacing said tool support means relative to said main support frame comprises a hydraulically actuated cylinder assembly.

16. An attachment according to claim 1 wherein said tool support means includes a bracket and said means for angularly displacing said tool relative to said tool support means operatively interconnects said bracket and a laterally disposed end portion of said tool.

17. An attachment according to claim 1 wherein said means for angularly displacing said tool support means relative to said main support frame comprises an extendable link.

18. An attachment according to claim 1 wherein said means for angularly displacing said tool relative to said tool support means comprises an extendable link.

19. A tool attachment means for a tractor comprising, a main support frame pivotally mountable on said tractor, an upwardly extending tool support means mounted on said main support frame for pivotal movement about a first generally longitudinal axis, a tool mounted on said tool support means for pivotal movement about a second upright axis, means for adjusting the position of the second axis relative to said tool support means about a transverse axis to adjust the pitch of the tool, means operatively interconnecting said main support frame and said tool support means for tilting said tool support means relative to said main support frame about said first axis, and means operatively interconnecting said tool support means and said tool for angularly displacing said tool relative to said tool support means about said second axis.

20. An attachment according to claim 19 wherein said pitch adjusting means includes a connecting member mountable on said tool, said connecting member being adjustable angularly relative to said tool about an axis, and said connecting member including means disposed eccentrically relative to said axis for connecting an end portion of said tool holding member.

21. An attachment according to claim 20 wherein said means for connecting an end portion of said tool holding means comprises a self-aligning bearing which receives said end portion.

22. An attachment according to claim 20 wherein said connecting member comprises a cap member detachably mounted on said tool member.

23. An attachment according to claim 22 wherein said cap member is detachably mounted on said tool by means of a set of bolts circumferentially spaced relative to said axis about which said cap member may be angularly adjusted.

24. An attachment according to claim 23 wherein said means for connecting an end portion of said tool support means comprises a self-adjusting bearing which receives said end portion.

25. An attachment according to claim 24 wherein said tool includes a mounting bracket having an opening therethrough, said cap member is mounted on said mounting bracket overlying said bracket opening and said end portion of said tool support means extends through said opening and connects to said cap member.

* * * * *